US006994048B1

(12) United States Patent
Jennings

(10) Patent No.: US 6,994,048 B1
(45) Date of Patent: Feb. 7, 2006

(54) FLOATING LOW DENSITY CONCRETE BARRIER

(75) Inventor: Nyal Jennings, Panama City Beach, FL (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 10/843,647

(22) Filed: May 3, 2004

(51) Int. Cl.
*B63B 35/44* (2006.01)

(52) U.S. Cl. ..... 114/266; 114/264; 405/63; 405/219

(58) Field of Classification Search ..... 114/264, 114/266, 267; 405/63, 219
See application file for complete search history.

(56) References Cited

FOREIGN PATENT DOCUMENTS

JP 56099889 A * 8/1981

JP 57130633 A * 8/1982

* cited by examiner

*Primary Examiner*—Jesus D. Sotelo
(74) *Attorney, Agent, or Firm*—James T. Shepherd

(57) ABSTRACT

A barrier for small boats has a plurality of flotation modules on lines extending across a waterway. The flotation modules are cast from a buoyant concrete mixture of cement, water, beaded forms of expanded polystyrene, and polypropylene fibers that is non-water-absorbing, crushable, not susceptible to failure in shear, and has a density lighter than water. The mixture can have cement with the beads in a ratio of about 1:3.5 by volume, the water with the cement in a ratio of about 0.5 (1:2) by weight and the fibers with the cement in a ratio of about 1:141 by weight. Lines pass thru the flotation modules and slip upon impact of a flotation module by a speeding boat, and the buoyant concrete mixture crushes to absorb some energy of the impact. The barrier is relatively low cost, can be made next to a waterway from readily available materials by unskilled workers and is deployed in a minimum amount of time.

19 Claims, 4 Drawing Sheets

FLOATING LOW DENSITY CONCRETE BARRIER

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

This invention relates to a barrier for small boats. More particularly, the invention is to a cost effective floating barrier for small boats that is cast from low density concrete.

Marine facilities including ships are vulnerable to sabotage by explosive laden small boats. Different access-obstructing structures have been placed on the water with varying degrees of effectiveness.

One floating structure has a series of elongate, voluminous hollow water pipes sealed at their ends that are strung across an access way. Additional hollow pipes are welded to and across them for added buoyancy and to stabilize a partitioned wall held above the water that hopefully deters, or deflects encroaching small boats. This ponderous pipe structure requires a time consuming fabrication procedure at a distant heavy construction site and a significant and further time consuming logistical effort to get it to the water and launched. The time spent could leave a waterway unprotected during a critical period.

Another floating wall structure that floats on the water's surface uses interconnected thin-walled shells, or pontoon-like cylinders that may be rigid metal or inflatable flexible bags. While these cylinders may be easier to deploy on the surface of the water than the hollow water pipe structures, their fabrication can be labor and time intensive. Their construction suggests they might not survive the long-term rigorous effects an corrosion of waves, tides, and the other operational abuses they will be routinely subjected to, and consequently may need frequent inspection and maintenance.

A modification of the interconnected pontoon-like cylinder design has an upwardly extending metal framework supporting an exposed net that extends from one end to the other. In addition to requiring increased maintenance, the additional framework and net further complicate fabrication, and the extra time spent might delay deployment and leave a marine facility unprotected.

Thus, in accordance with this inventive concept, a need has been recognized in the state of the art for a cost effective, low maintenance easily fabricated barrier for deterring small boats from marine facilities.

OBJECTS AND SUMMARY OF THE INVENTION

An object of the invention is to provide a barrier to keep small boats away from marine facilities.

Another object of the invention is to provide a small boat barrier that is cost effective and can be quickly made near a deployment site by relatively unskilled workers.

Another object of the invention is to provide a barrier for small boats easily manufactured at a marine facilities site that allows for growth of marine organisms.

Another object of the invention is to provide a barrier for small boats having a capability for lights, sensors, and other payload to allow the barrier to be used as a floating platform.

Another object of the invention is to provide a barrier for small boats having sufficient mass to absorb the energy of an impacting small boat.

Another object of the invention is to provide a barrier for small boats made from a buoyant concrete mixture having a density of 35 to 50 lb/ft$^3$.

Another object is of the invention to provide a barrier for small boats made from a buoyant concrete matrix moldable into a variety of shapes to allow barriers to be designed for a variety of applications.

Another object is to provide a barrier for small boats having lines passing thru and extending between serially arranged adjacent floating modules made from moldable buoyant concrete to transfer energy from one floating portion to the next to absorb energy from an impacting small boat or rough weather.

Another object is to provide a barrier for small boats having flotation modules with lines passing thru them with minimal gap between adjacent the flotation modules.

Another object is to provide a barrier for small boats not utilizing metal structure to reduce the problems otherwise associated with corrosive materials in salt water.

These and other objects of the invention will become more readily apparent from the ensuing specification when taken in conjunction with the appended claims.

Accordingly, the present invention provides a barrier for small boats. A plurality of flotation modules is cast from a buoyant concrete mixture of cement, water, beaded forms of expanded polystyrene, and polypropylene fibers that is non-water-absorbing, crushable, when compressed or impacted, causes local crushing not shear, and has a density lighter than water. One buoyant concrete mixture includes (weight=1562.5 pounds, volume=59.9 cubic feet, density=26.1 pounds per cubic foot) 1004 pounds of cement, 552 pounds of water, and 7 pounds of polypropylene fibers per volume of 48 cubic feet of polystyrene beads. The cement and water are mixed, then foam and beads at approximately 12 cubic feet of foam to 1.5 pounds of fiber are mixed into the cement/water slurry. The mixture can have cement to beads at a ratio of 1:3.5 by volume, the water to cement ratio can be 0.5 (or 1:2) by weight and the fiber to cement ratio can be 1:141 by weight. Upon pouring, the mixture is pressed with approximately 0.1 psi pressure to remove air pockets and ensure the foam is encapsulated by the cement. Lines freely passing thru channels in the flotation modules and between the flotation modules form the barrier. The lines slip and give through the channels upon impact by a speeding boat and the buoyant concrete mixture crushes to absorb some energy of the impact. Barrier is relatively low cost and can be made next to a waterway from readily available materials by unskilled workers and deployed in a minimum amount of time.

DESCRIPTION OF THE PREFERRED EMBODIMENT

Figure 1:
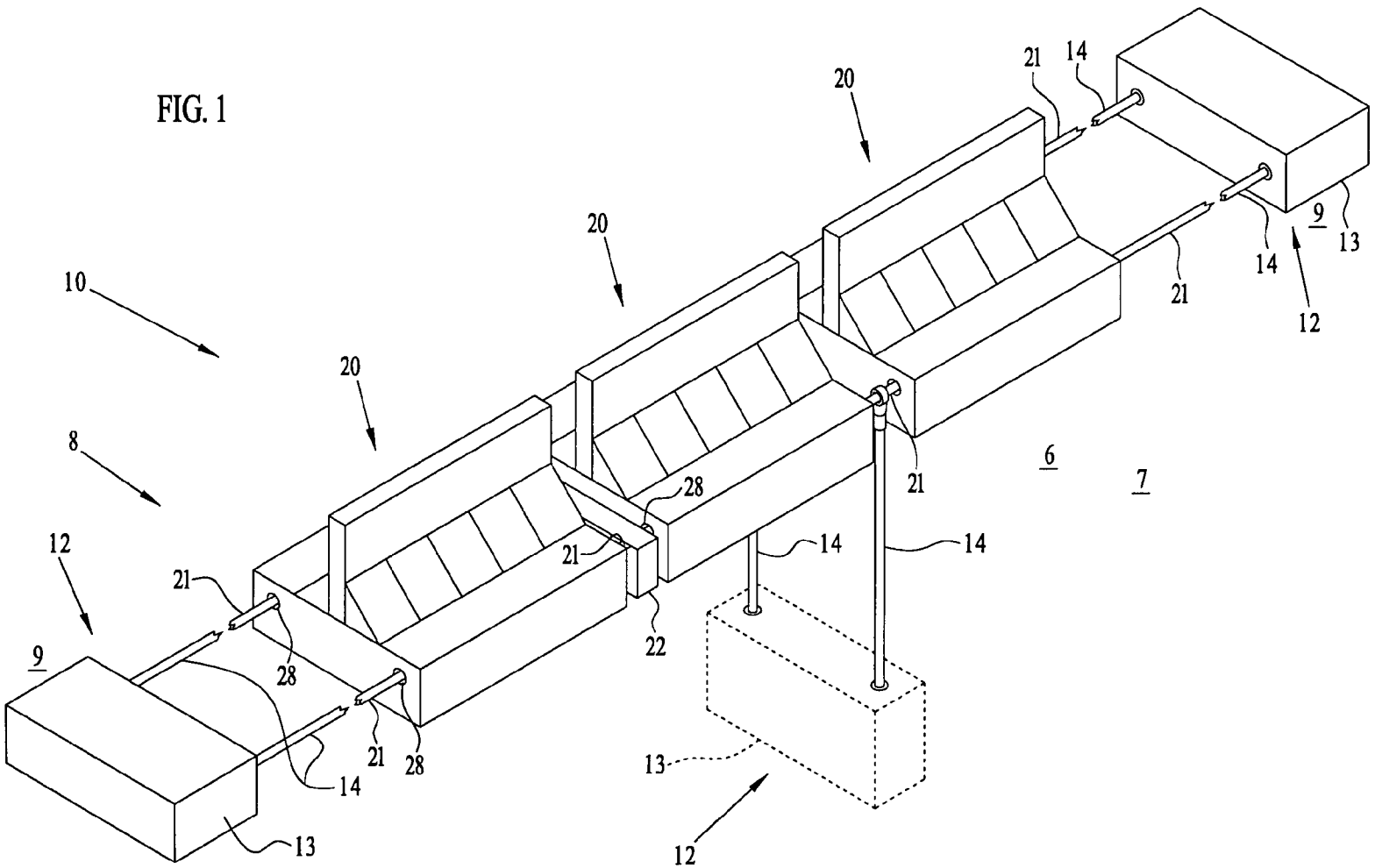
FIG. 1 is a schematic representation of a barrier for small boats of the invention.
Figure 2:
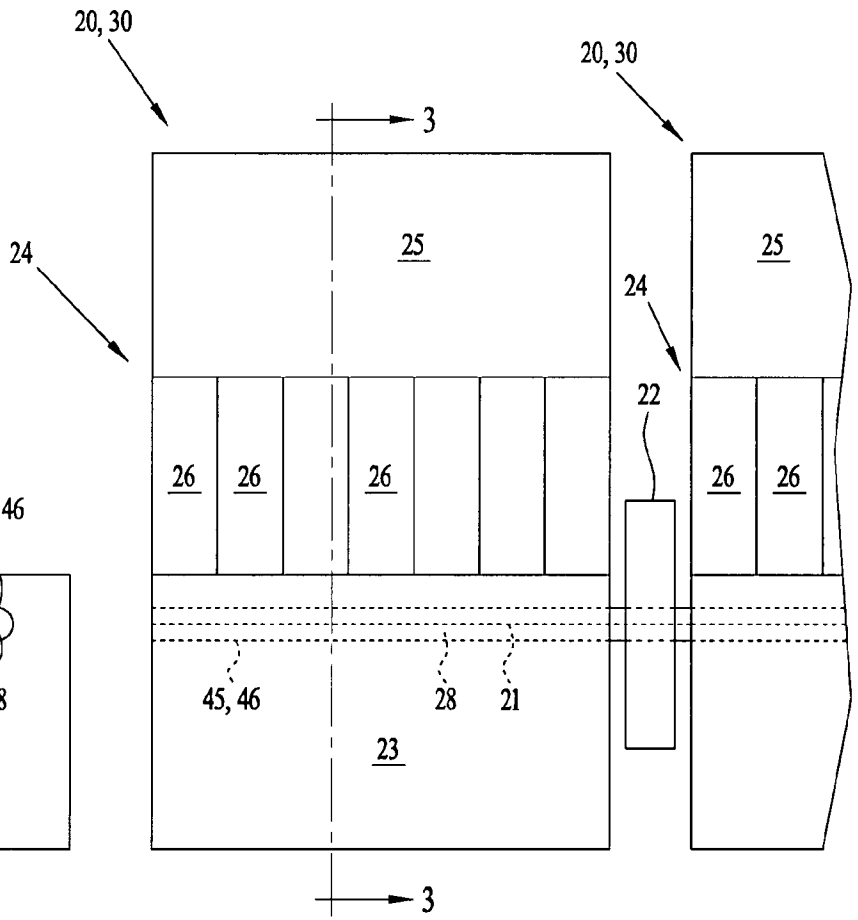
FIG. 2 is a partially cross-sectional schematic representation of a side view of interconnected flotation modules of a barrier for small boats of the invention.
Figure 3:
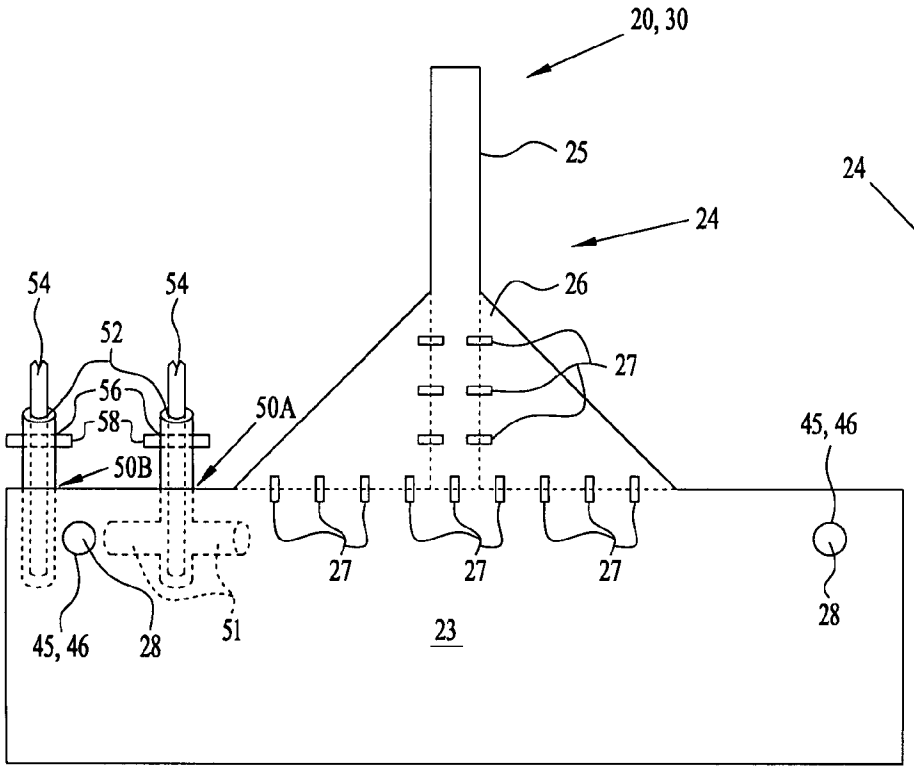
FIG. 3 is a schematic cross-sectional representation of a end view of a flotation module taken along lines 3—3 in FIG. 2.

Referring to FIGS. 1, 2, and 3, a barrier 10 for small boats floats on water 6 and extends across a waterway surface 7 or along a perimeter 8 bordering marine facilities such as supply or fueling docks, warehouses, anchored ships, etc. that are to be closed to traffic from small boats. Barrier 10 has a sufficient number of cast flotation modules 20 on lines 21 extending through adjacent flotation modules 20 to reach across waterway surface 7 or along the length of perimeter 8 to anchoring systems 12. Anchoring systems 12 include an anchor 13 and lines 14 that are connected to lines 21 not only at opposite ends of barrier 10, but may be coupled to lines 21 along the length of barrier 10. Lines 21 and 14 can include stretchable nylon or other non-corrosive energy absorbing material or wire rope or chain to help absorb the energy of impacting craft. At least one resilient cushion structure 22 is interposed between adjacent flotation modules 20 to prevent them from knocking against each other and damaging themselves by motions caused by waves, currents and/or impact by small boats.

An exemplary flotation module 20 shown herein has an elongate rectangular-shaped base section 23 and an elongate upright section 24 composed of an elongate rectangular-shaped portion 25 and a pair of elongate triangular portions 26. Elongate rectangular-shaped base section 23 and elongate rectangular-shaped upright portion 25 and pair of elongate triangular portions 26 of elongate upright section 24 can be cast as an integral unit or cast separately for ease of handling and joined together by conventional non-corrosive connective members 27 extending into them. An exemplary size for flotation modules 20 has section 23 being eight feet long, eight feet wide, and two-and one-half feet high, and portion 25 of section 24 extending four feet above the top of section 23 with portion 26 of section 24 reaching about two and one half feet above the top of section 23. This creates a wall extending at least four feet above the water line of each flotation module 20. It is understood that many other three-dimensional configurations for flotation modules 20 could be cast as desired, depending on the shapes of the molds.

Figure 4:
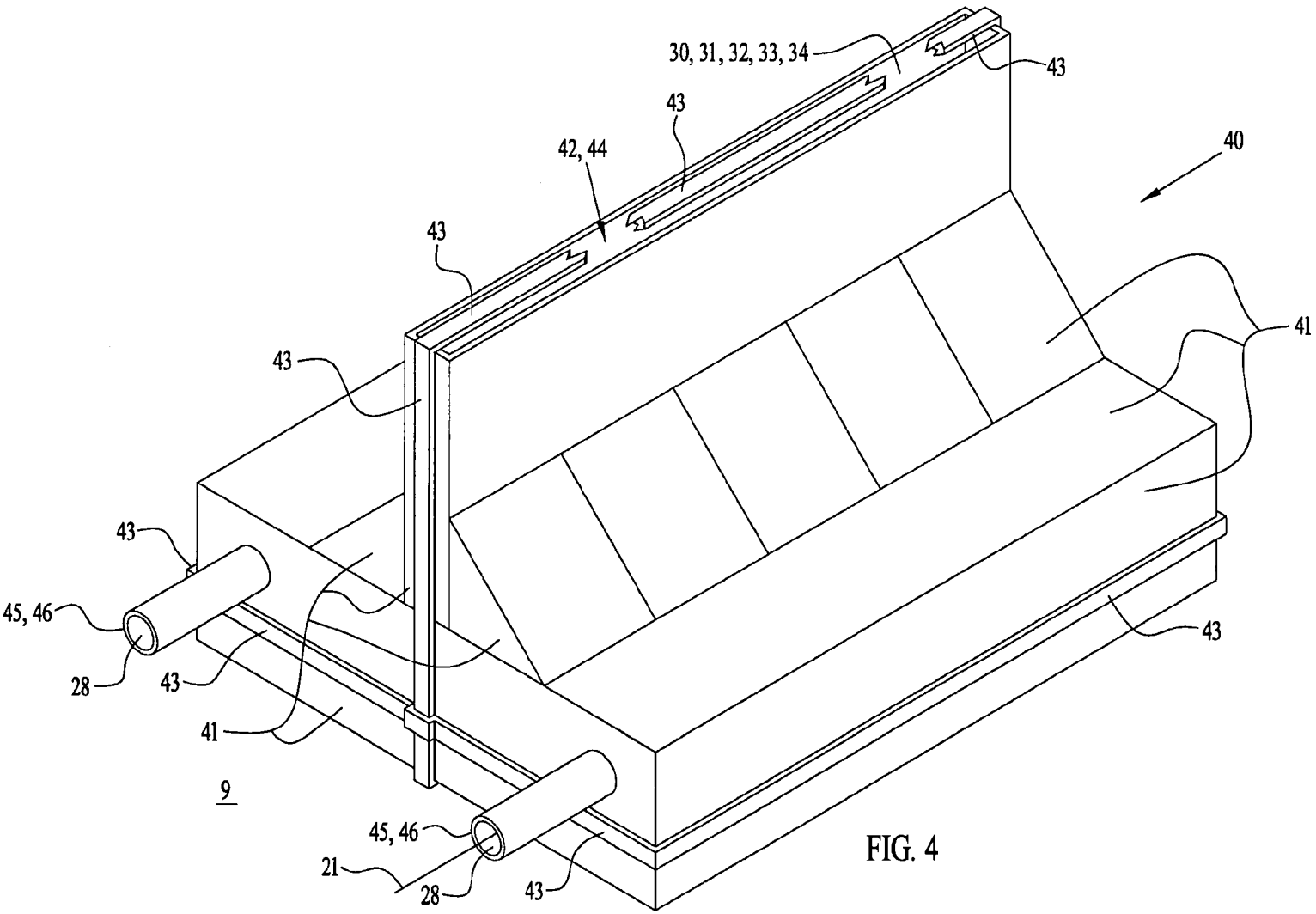
FIG. 4 schematically shows a typical casting mold for a flotation module.

Referring also to FIG. 4, flotation modules 20 are made from a buoyant concrete mixture 30. Flotation modules 20 can be quickly cast onshore 9 nearby waterway surface 7 by relatively unskilled workmen soon after notice is received that barrier 10 is needed. Each flotation module 20 can be made in a hollow mold 40 that can be differently configured to allow casting of different three-dimensional shapes in different sizes according to the task at hand and materials available.

Molds 40 can be quickly made from parts 41 of new or reclaimed lumber and/or sheet stocks of metal or other compositions that are readily available or obtainable at virtually all shore based installations. Molds 40, only one of which is shown in FIG. 4, can be made of lumber parts 41 including planks and plywood sheet or other construction materials that can be nailed, bolted or otherwise held together. Mixed liquid buoyant concrete mixture 30 can fill mold 40 to the full extent of flotation module 20 through an open rectangular-shaped upper end 42 of mold 40.

Fabric straps or metal straps/rods 43 can be placed around parts 41 to help hold them together. The added lateral holding force exerted by straps/rods 43 may be needed to maintain the shape of mold 40 and hold the weight of the volume of liquid buoyant concrete mixture 30 that fills casting chamber 44 of mold 40. Hollow tubes 45, PVC tubes for example, or structural rods 46 can be cast into the concrete mix. Lines 21 can run through elongate channels 28 formed inside hollow tubes 45 or lines 21 can be attached to opposite ends of structural rods 46.

When liquid buoyant concrete mixture 30 cures and hardens, straps 43 and parts 41 of mold 40 can be rapidly disassembled. The cast and solid flotation module 20 can be transported over the relatively short distance from where it was cast onshore 9 and to where it is to be deployed on waterway surface 7 in barrier 10. Disassembled parts 41 and straps 43 can be quickly reassembled as mold 40 that again defines an empty casting chamber 44 for casting another flotation module 20. Thus, barrier 10 of the invention can be quickly fabricated onshore 9 as near to the site of deployment on water 7 as practicable, and, as compared to contemporary floating obstructions, the problems associated with making and moving the complicated and ponderous structures of the prior art are greatly reduced.

Concrete mixture 30 of flotation modules 20 has a density less than water to be buoyant and does not absorb water (after initial water absorption) to allow flotation module 20 to float at waterway surface 7 of water 6. Buoyant concrete mixture 30 of flotation module 20 is made to be crushable and is not susceptible to failure in shear, i.e., does not crack or shear when impacted by small boats. This capability absorbs and dissipates the energy of an impacting small boat to prevent an impacting craft from breaking through barrier 10. Buoyant concrete mixture 30 has no corrosive elements that would otherwise deteriorate in a corrosive salt water environment and needs little, if any, maintenance.

Buoyant concrete mixture 30 is buoyant and non-corrosive because of its unique mixed composition of cement 31, water 32, beaded forms of expanded polystyrene 33 and polypropylene fibers 34. Conventional concretes used for roadways, buildings, etc. are too heavy and tend to crack and fail in shear (without reinforcing rods or mesh) partially because they contain heavy, hard, inert aggregate. In comparison, buoyant concrete mixture 30 of the invention has non-water-absorbing polystyrene beads 33 and polypropylene fibers 34 to be buoyant and crushable without shearing-off to absorb some of the energy of an impacting craft.

Buoyant concrete mixture 30 has a density of between 35 to 50 pounds per cubic foot. This provides a sufficient mass density in flotation modules 20 of barrier 10 to absorb the energy of an impacting craft. The beaded forms of expanded polystyrene 33 are typically called "regrind" in the art since it is recycled polystyrene that has been shredded into bits. Other plastic-like compositions could be selected instead of the recycled polystyrene provided that the compositions are tough enough to be crushable, do not absorb water, do not crack or crumble in a shear-failure condition and have a density that is lighter than water. One commercially available composition that is suitable has been marketed under the trademark STYROFOAM by E.I. du Pont de Nemours and Company of Wilmington, Del. 19898. Furthermore, other fiber compositions could be used instead of polypropylene fibers 34 provided that the other compositions are tough enough to hold the cured buoyant concrete mixture 30 together as flotation module 20, are crushable in impact, resist failure in shear, do not absorb water and have a density that is lighter than water.

Glass micro-spheres may provide required flotation and structural requirements. However they may be too fragile to mix. In addition, they are too expensive for building enough flotation modules 20 for an extended barrier 10. Incorporation of the insulating material, heated and expanded perlite silicous rock, in place of polystyrene beads 33 in buoyant concrete mixture 30 is not acceptable since the perlite insulating materials absorb water and, consequently, would not provide the necessary amount of buoyancy for flotation modules 20 of the invention.

One exemplary composition for buoyant concrete mixture 30 for flotation modules 20 has one part cement 31 to three and one-half parts of polystyrene beads 33 by volume. This exemplary mix has 1004 pounds of cement 31, 552 pounds of water 32, and 7 pounds of polypropylene fibers 34 per volume of 49 cubic feet of polystyrene beads 33. The cement and water are mixed, then foam and beads at approximately 12 cubic feet of foam to 1.5 pounds of fiber are mixed into the cement/water slurry. The mixing can have the cement and the beads in a ratio of about 1:3.5 by volume, the water and the cement in a ratio of about 0.5 (1:2) by weight and the fibers and the cement in a ratio of about 1:141 by weight. Upon pouring into molds, the mixture is pressed with approximately 0.1 psi pressure to remove air pockets and ensure the foam is encapsulated by the cement. This buoyant concrete mixture 30 has a density of 43 pounds per cubic foot, and after curing, can sustain a compression crush stress of about 150 pounds per square inch that fails by localized crushing and not by breaking (shearing). In other words, upon impact, the cured buoyant concrete mixture 30 of flotation modules 20 is impact resistant and crushes locally (at the point of impact) whereas typical contemporary concrete cracks and shears.

Flotation module 20 dimensioned as disclosed above and composed of buoyant concrete mixture 30 as described above can support a load of an additional 1700 pounds. This buoyancy allows for growth of marine life, and equipment and personnel can be supported on each flotation module 20. Since there is only cured buoyant concrete mixture 30, lines 21 and cushions 22 between adjacent flotation modules 20 and no corrosive metals or other degradable materials, maintenance is minimized.

A liquid slurry or matrix of mixed components 31, 32, 33, and 34 of buoyant concrete mixture 30 is moldable into a variety of shapes allowing flotation modules 20 of barrier 10 to be designed to also function as ship-to-shore ramps, access docks, etc. In addition to creating differently shaped barriers 10, different ones of flotation modules 30 can create stable platforms to attach lights, sensors, and other equipment. In addition to use as barrier 10, flotation modules 20 fabricated from buoyant concrete mixture 30 can have many applications including low cost floating breakwaters, house boats, floating piers, boat docks and jet-ski docks, for examples. Equipment can be added using standard masonry techniques. For example FIG. 3 shows PVC (or metal) pipes 50A, 50B that have been cast into base section 23. Pipes 50A, 50B have tubular openings 52 to receive and allow the addition of the leg-like PVC, or steel structural members 54 connected to signs, posts, net and equipment supports, etc. on flotation modules 20. Holes 56 in pipes 50A, 50B align with corresponding holes in structural members 54 to receive pins 58 and secure structural members 54 to flotation modules 20. Lateral parts 51 of pipe 50A are cast in base section 23 to make a stronger fitting by increasing the force needed to pull pipe 50A out of base section 23.

Lines 21 have been disclosed as freely passing thru elongate channels 28. This allows flotation modules 20 to slip along lines 21 and provide additional "give" in barrier 10 to absorb or dissipate some of the energy of an impacting high speed boat or rough weather without increasing the load on flotation modules 20. Lines 21 extend only a relatively short distance between adjacent flotation modules 20 (where cushions 22 are located) so that an encroaching small boat will have to impact at least one flotation module 20 and not be able to slip between them. Lines 21 provide energy transfer from one flotation module 20 to the next, and as mentioned above, can be made from stretchable nylon or other strong partially resilient fiber to also absorb some of the energy of impact.

Figure 5:
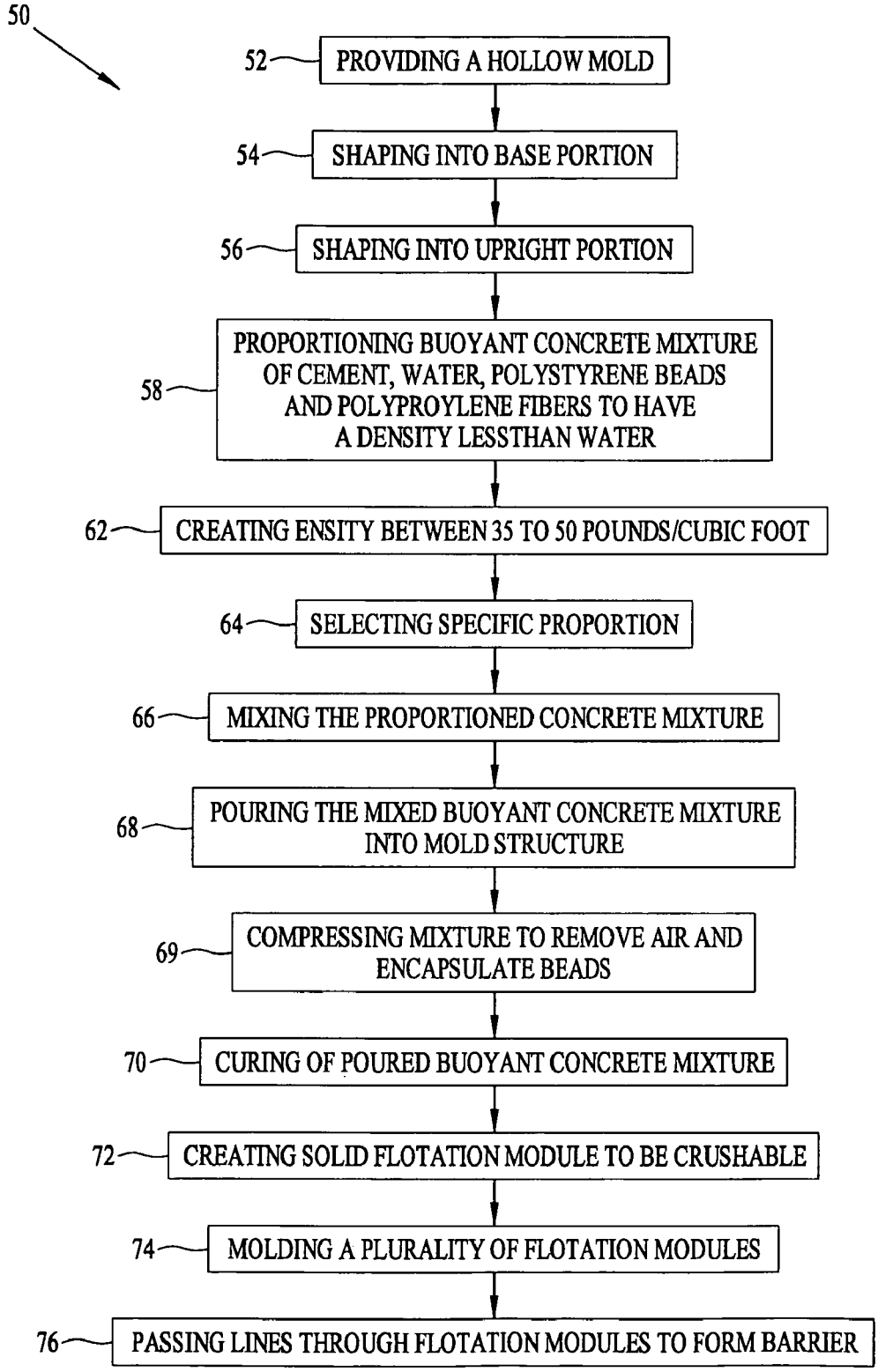
FIG. 5 is a schematic representation of the method of fabricating a barrier for small boats.

Referring to FIG. 5 a method 50 of making a floating barrier 10 calls for providing 52 a hollow mold structure 40. Providing 52 includes shaping 54 mold structure 40 to define an elongate rectangular-shaped base section 23 and shaping 56 mold structure 40 to define an elongate rectangular-shaped upright section 24. Next, method 50 call for proportioning 58 buoyant concrete mixture 30 of cement 31, water 32, beaded forms of expanded polystyrene 33, and polypropylene fibers 34 to have a density of less than water. Such proportioning 58 leads to creating 62 a density of buoyant concrete mixture 30 of flotation modules 20 in the range of thirty-five to fifty pounds per cubic foot.

Specifically proportioning 58 of constituents of buoyant concrete mixture 30 can be selecting 64 specific proportions that have 1004 pounds of cement 31, 552 pounds of water 32, and 7 pounds of polypropylene fibers 34 per volume of 49 cubic feet of polystyrene beads 33. Mixing 66 the proportioned buoyant concrete mixture 30, pouring 68 the mixed buoyant concrete mixture 30 in hollow mold structure 40 and compressing 69 mixture 30 by about 0.1 psi pressure to remove air and encapsulate the beads with concrete, allows curing 70 of the poured buoyant concrete mixture 30 into a solid flotation module 20 and the creating 72 of solid flotation module 20 to be crushable and not susceptible to failure in shear. The step of mixing 66 can also include mixing the cement with the beads in a ratio of about 1:3.5 by volume, the water with the cement in a ratio of about 0.5 (1:2) by weight and the fibers with the cement in a ratio of about 1:141 by weight. Molding 74 a plurality of flotation modules 20 that each have elongate channels 28, and passing 76 lines 21 through elongate channels 28 makes a low-cost, effective barrier 10 that can be selectively anchored.

Having the teachings of barrier 10, flotation modules 20, and buoyant concrete mixture 30 of this invention in mind, different applications, modifications and alternate embodiments of this invention may be adapted. The disclosed components and their arrangements as disclosed herein all contribute to the novel features of this invention. Barrier 10 of this invention is cost-effective, and is quickly made and deployed by relatively unskilled workers where it is needed. Numbers of flotation modules 20 made from buoyant concrete mixture 30 are relatively maintenance free and can be added as needed according to changing needs. Therefore, barrier 10, as disclosed herein is not to be construed as limiting, but rather, is intended to be demonstrative of this inventive concept.

It should be readily understood that many modifications and variations of the present invention are possible within the purview of the claimed invention. It is to be understood that within the scope of the appended claims the invention may be practiced otherwise than as specifically described.

I claim:

1. A floating barrier for small boats comprising:

a plurality of flotation modules cast from a buoyant concrete mixture, said buoyant concrete mixture being non-water-absorbing, crushable, not susceptible to failure in shear and have a density lighter than water; and lines extending between said flotation modules to form a barrier, said lines freely passing thru said flotation modules.

2. The barrier of claim 1 further comprising:

elongate channels in said flotation modules each receiving one of said lines extending therethrough, and resilient cushion structure between adjacent ones of said flotation modules.

3. The barrier of claim 2 further comprising:

anchoring systems connected to said lines.

4. The barrier of claim 3 wherein said lines slip and give through said elongate channels upon impact of a flotation module by a boat, said buoyant concrete mixture crushes to absorb some energy of said impact and said lines and said anchoring systems also absorb some energy of said impact.

5. The barrier of claim 4 wherein said buoyant concrete mixture has a density of between 35 to 50 pounds per cubic foot.

6. The barrier of claim 5 wherein said buoyant concrete mixture includes cement, water, beaded forms of expanded polystyrene, and polypropylene fibers.

7. The barrier of claim 6 wherein said buoyant concrete mixture has 1004 pounds of said cement, 552 pounds of said water, and 7 pounds of said polypropylene fibers per volume of 49 cubic feet of said polystyrene beads.

8. The barrier of claim 6 wherein said buoyant concrete mixture has a mixture of cement to beads at a ratio of 1:3.5 by volume, water to cement ratio at 1:2 by weight and fiber to cement ratio at 1:141 by weight.

9. The barrier of claim 7 wherein said buoyant concrete mixture has a density of 43 pounds per cubic foot, and after curing, can sustain a compression crush stress of about 150 pounds per square inch.

10. A flotation module comprising:

a buoyant concrete mixture being non-water-absorbing, crushable, not susceptible to failure in shear and of a density less than water, wherein said buoyant concrete mixture includes cement, water, beaded forms of expanded polystyrene, and polypropylene fibers; and elongate channels cast in said buoyant concrete mixture to receive lines therethrough.

11. The flotation module of claim 10 wherein said buoyant concrete mixture has 1004 pounds of said cement, 552 pounds of said water, and 7 pounds of said polypropylene fibers, per volume of 49 cubic feet of said polystyrene beads.

12. The flotation module of claim 11 wherein said buoyant concrete mixture has a density of approximately 43 pounds per cubic foot, and after curing, can sustain a compression crush stress of about 150 pounds per square inch.

13. A method for making a floating barrier comprising the steps of:

providing a hollow mold structure;

proportioning a buoyant concrete mixture of cement, water, beaded forms of expanded polystyrene, and polypropylene fibers to have a density less than water;

mixing the proportioned buoyant concrete mixture;

pouring the mixed buoyant concrete mixture into said hollow mold structure;

compressing said mixture to remove air and encapsulate said beaded forms with concrete and curing said poured buoyant concrete mixture into a solid flotation module.

14. The method of claim 13 wherein said step of curing includes the step of;

creating said solid flotation module to be crushable and to not typically fail in shear.

15. The method of claim 14 wherein said step of proportioning includes the step of:

creating a density of said flotation module in the range of thirty-five to fifty pounds per cubic foot.

16. The method of claim 15 wherein said step of providing includes the steps of: shaping said mold to define an elongate rectangular-shaped base portion; and shaping said mold to define an elongate rectangular-shaped upright portion.

17. The method of claim 16 wherein said step of proportioning said buoyant concrete mixture comprises the step of:

selecting 1004 pounds of said cement, 552 pounds of said water, and 7 pounds of said polypropylene fibers per volume of 49 cubic feet of said polystyrene beads.

18. The method of claim 17 further including the steps of:

mixing said cement to said beads in a ratio of about 1:3.5 by volume, said water to said cement in a ratio of about 0.5 (1:2) by weight and said fibers to said cement in a ratio of about 1:141 by weight.

19. The method of claim 18 further including the steps of:

molding a plurality of flotation modules each having elongate channels therein; and passing lines through said channels to form said barrier.

* * * * *